US008381777B2

(12) United States Patent
Lupi et al.

(10) Patent No.: US 8,381,777 B2
(45) **Date of Patent: *Feb. 26, 2013**

(54) FILLING VALVE HAVING A LIQUID CHAMBER, A GAS CHAMBER AND A MEDIUM CHAMBER, AND FILLING MACHINE COMPRISING THE SAME

(75) Inventors: Andrea Lupi, Octeville-sur-Mer (FR); Roberto Cuoghi, Octeville-sur-Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 1310 days.

This patent is subject to a terminal disclaimer.

(21) Appl. No.: 11/997,054

(22) PCT Filed: Jul. 28, 2005

(86) PCT No.: PCT/EP2005/009215

§ 371 (c)(1),
(2), (4) Date: Jan. 28, 2008

(87) PCT Pub. No.: WO2007/016960

PCT Pub. Date: Feb. 15, 2007

(65) Prior Publication Data

US 2008/0210334 A1 Sep. 4, 2008

(51) Int. Cl.
*B65B 3/04* (2006.01)
*B65B 31/04* (2006.01)

(52) U.S. Cl. ..... 141/48; 141/64; 141/144; 141/192; 141/198; 141/392

(58) Field of Classification Search ..... 141/47–48, 141/63–64, 144–146, 192, 198, 392
See application file for complete search history.

(56) References Cited

U.S. PATENT DOCUMENTS 4,369,820 A * 1/1983 Ahlers et al. ..... 141/39
4,386,635 A * 6/1983 Ahlers et al. ..... 141/6
4,509,565 A * 4/1985 Ahlers ..... 141/39

(Continued)

FOREIGN PATENT DOCUMENTS

DE 43 11 202 C1 10/1994
DE 10025577 * 2/2001

(Continued)

OTHER PUBLICATIONS

Machine Translation of DE10025577, Feb. 2001, all pages.*

*Primary Examiner* — Gregory Huson
*Assistant Examiner* — Nicolas A Arnett
(74) *Attorney, Agent, or Firm* — Sughrue Mion, PLLC

(57) ABSTRACT

A filling valve includes a hollow housing including a liquid chamber, a gas chamber, and a sliding valve assembly. The sliding valve assembly includes a hollow valve rod with an opening in the gas chamber at an upper end of the valve rod, the valve rod sliding in the housing between an open position where valve rod opens an aperture in the housing allowing liquid to flow from the liquid chamber through the aperture, and a closed position where the valve rod closes the aperture, and a sliding piston disposed in the housing between an open position where a lower end of the piston is spaced from the upper end of the valve rod allowing gas to pass from the gas chamber to the opening in the valve and a closed position where the lower end of the piston contacts the upper end of the valve rod.

11 Claims, 7 Drawing Sheets

U.S. PATENT DOCUMENTS 4,557,301 A * 12/1985 Jorss ..... 141/5
4,757,847 A * 7/1988 Jorss et al. ..... 141/198
5,000,234 A * 3/1991 Weiss ..... 141/6
5,082,033 A * 1/1992 Weiss ..... 141/39
5,273,082 A * 12/1993 Paasche et al. ..... 141/6
5,377,726 A * 1/1995 Clusserath ..... 141/39
5,501,253 A * 3/1996 Weiss ..... 141/40
5,634,500 A * 6/1997 Clusserath et al. ..... 141/48
5,735,434 A * 4/1998 Rayner ..... 222/1
5,826,748 A * 10/1998 Qian et al. ..... 222/1
6,079,460 A * 6/2000 Ballan et al. ..... 141/145
6,192,947 B1 * 2/2001 Ballan et al. ..... 141/49
6,237,651 B1 * 5/2001 Fuin et al. ..... 141/250
6,463,964 B2 * 10/2002 Clusserath ..... 141/40
6,601,618 B2 * 8/2003 Tsukano et al. ..... 141/45
6,817,386 B2 * 11/2004 Tsukano et al. ..... 141/57
6,892,771 B2 * 5/2005 Stocchi ..... 141/129
7,647,950 B2 * 1/2010 Clusserath ..... 141/56
2004/0112460 A1 * 6/2004 Stocchi ..... 141/144

FOREIGN PATENT DOCUMENTS

EP 0 628 512 A1 12/1994
EP 1 262 446 A1 12/2002

* cited by examiner

FILLING VALVE HAVING A LIQUID CHAMBER, A GAS CHAMBER AND A MEDIUM CHAMBER, AND FILLING MACHINE COMPRISING THE SAME

FIELD OF THE INVENTION

The invention relates to a filling valve for filling a container with a pressurized filling liquid such as a carbonated drink, and to an isobaric filling machine including such a filling valve.

BACKGROUND OF THE INVENTION

The general principles of isobaric filling method are explained in European patent application No. EP 0 375 912. In the known isobaric method, part of the volume of a storage tank is filled with a liquid, the overlying other part being filled with a gas maintained at a pressure equal to the liquid saturation pressure. To fill a container, the container interior is put into communication with the tank via two pipes, a first of which opens into the upper part of the tank in the gas volume, whereas the second pipe opens into the lower part of the tank in liquid volume. In each pipe a shut-off valve is provided to close the relative pipe. To fill the bottle the valve of the gas pipe is opened so that the gas flows into the container. While keeping the valve of the gas pipe open, the valve of the liquid pipe is open so that the liquid falls into the container. Once reaching the filling level, the valves are stopped.

U.S. Pat. No. 6,601,618 and European patent application No. EP 1 101 998 both disclose a filling valve for the isobaric filling of a container, said filling valve having a hollow valve rod slidingly mounted in a valve housing. The valve rod is provided with a through hole defining a gas passage, and a liquid passage is defined between the outer periphery of the valve rod and the inner periphery of the housing.

These conventional filling method and filling valves require a somewhat complex network of gas and liquid pipes, provided with numerous shut-off valves which need to be precisely synchronized under control of an appropriate control device.

SUMMARY OF THE INVENTION

It is an object of the invention to provide a filling valve permitting to simplify the structure of the filling machine equipped therewith, and also permitting a simpler filling method.

The proposed filling valve comprises:

a hollow housing;

a moving valve assembly slidingly mounted in the housing, said moving valve assembly and said hollow housing together defining a liquid chamber and a gas chamber;

a liquid inlet for putting said liquid chamber into communication with a liquid supply pipe;

a gas inlet for putting said gas chamber into communication with a gas supply pipe;

wherein said moving valve assembly comprises:

a hollow valve rod provided with a through hole opening in said gas chamber at an upper end of said valve rod, said valve rod being slideable with respect of the housing between an open position in which the valve rod opens an aperture in the housing, thereby allowing liquid to flow from the liquid chamber through said aperture, and a closed position in which the valve rod closes said aperture, and a piston slidingly mounted in the housing between an open position in which a lower end of the piston is spaced from the upper end of the valve rod, thereby allowing gas to pass from the gas chamber to the through hole in the valve rod through the opening formed at the upper end thereof, and a closed position in which the lower end of the piston is in sealing contact with the upper end of the valve rod.

There is also provided an isobaric filling machine equipped with a plurality of such filling valves for filling containers with a gas saturated liquid.

The above and other objects and advantages of the invention will become apparent from the detailed description of preferred embodiments, considered in conjunction with the accompanying drawings.

DESCRIPTION OF A PREFERRED EMBODIMENT

Figure 1:
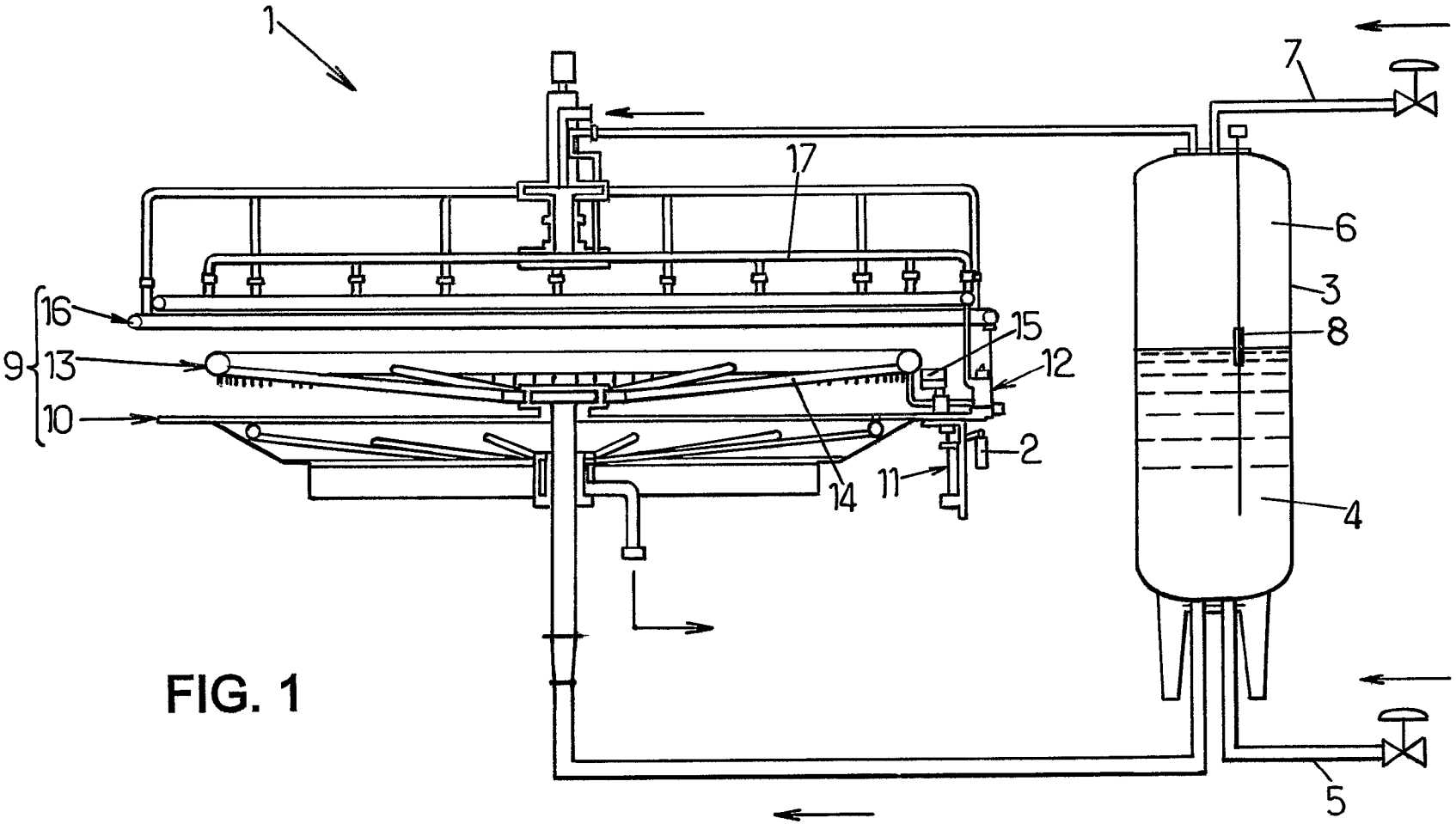
FIG. 1 is a schematic side elevational section view of a filling machine according to the invention.

Referring to FIG. 1, there is shown a filling machine 1 for filling containers 2 with a pressurized filling liquid (such as mineral water, soft drink, beer and the like), saturated with a gas such as $CO_2$.

The filling machine 1 comprises a vessel-shaped storage tank 3 defining a liquid space 4 in communication with a liquid supply duct 5 and an overlying gas space 6 in communication with a gas supply duct 7.

The liquid is maintained at a predetermined level by means of a control device including a level probe 8 located inside the storage tank 3, whereas the gas is maintained at a predetermined pressure equal to or above the liquid saturation pressure at the storage tank temperature, so that the filling liquid is constantly $CO_2$-saturated, in equilibrium with the overlying gas space 6.

The filling machine 1 is of the rotary type, and comprises a carrousel 9 rotated by drive means (not shown) and including:

a lower plate 10 provided with a plurality of peripheral container support arrangements 11 (one of which is partly shown on FIG. 2), and with a plurality of corresponding filling valves 12, a medium plate 13 including a plurality of radial liquid supply pipes 14, each of which is in communication with the liquid space 4 of the storage tank 3 and connected to a filling valve 12 via a flow meter 15, and an upper plate 16 including a plurality of radial gas supply pipes 17 in communication with the gas space 6 of the storage tank 3 and connected to the filling valves 12.

The container support arrangement 11 includes a support arm 18, an upper end 19 of which is forked to cooperate with a collar 20 of a container 2 to be filled through the corresponding filling valve 12.

The filling uses the so-called isobaric method. Such a method, well explained in the European patent application No. EP 0 375 912, has two main features. First, before being filled with liquid, the container 2 is previously filled with pressurized gas from the storage tank 3; second, the liquid leaves the filling valve 12 at a level which is lower than the level of the liquid space 4 in the storage tank 3.

Figure 3:
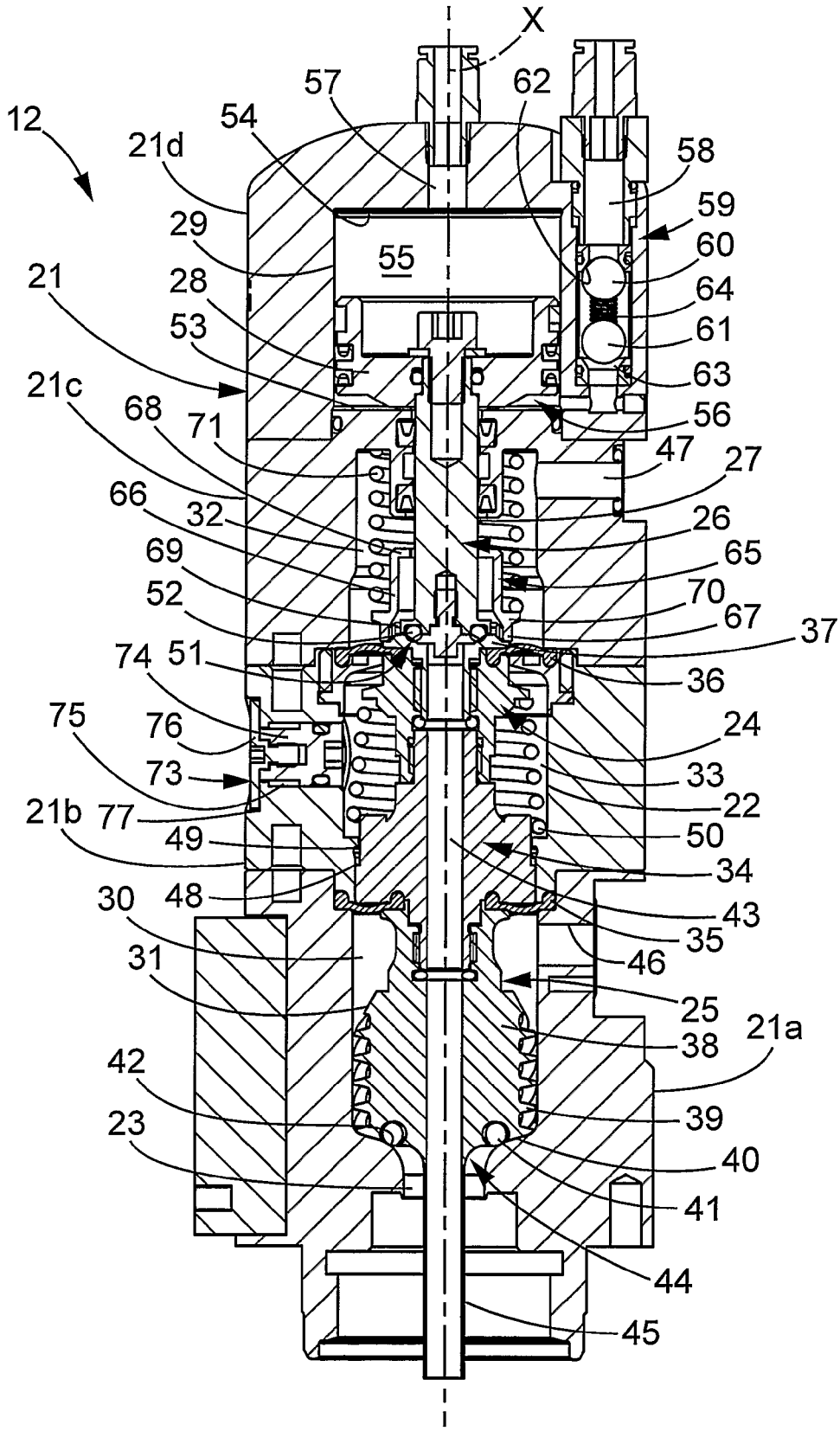
FIG. 3 is a side elevational section view showing a filling valve according to the invention, in a closed configuration.

As depicted on FIG. 3, the filling valve 12 comprises a cylindrical hollow housing 21 having an inner bore 22 formed around a vertical main axis X and opened to form an aperture 23 at a bottom end of the housing 21, and a moving valve assembly 24 slidingly mounted in the housing 21 along the main axis X. The housing 21 is formed by superposition of four cylindrical coaxial stages 21*a*, 21*b*, 21*c*, 21*d* screwed to each other, i.e. a lower housing stage 21*a*, a first medium housing stage 21*b*, a second medium housing stage 21*c*, and an upper housing stage 21*d*.

The moving valve assembly 24 comprises two stages movable with respect of each other, i.e. a lower stage formed of a hollow valve rod 25, and an upper stage formed of a piston 26 having a cylindrical piston body 27 and a piston head 28 slidingly received in an air chamber 29 formed of a cylindrical bore in the upper housing stage 21*d*.

As depicted on FIG. 3, the valve assembly 24 and the housing 21 together define:

- a liquid chamber 30 formed between the outer periphery of a lower part 31 of the valve rod and the inner periphery of the housing bore 22 in the lower housing stage 21*a;*
- a gas chamber 32 formed between the outer periphery of the piston body 27 and the inner periphery of the housing bore 22 in the second medium housing stage 21*c*, and
- a medium chamber 33 formed between the outer periphery of an upper part 34 of the valve rod 25 and the inner periphery of the housing bore 22 in the first medium housing stage 21*b*, i.e. between the liquid chamber 30 and the gas chamber 32.

The valve 12 comprises a first or lower diaphragm 35, linking the valve assembly 24 and the housing 21. The lower diaphragm 35 is held liquid tight on the one hand between the lower part 31 and the upper part 34 of the valve rod 25, on the other hand between the lower housing stage 21*a* and the first medium housing stage 21*b*, whereby the lower diaphragm 35 forms a liquid tight flexible seal between the liquid chamber 30 and the medium chamber 33.

The valve 12 further comprises a second or upper diaphragm 36, linking the valve assembly 24 and the housing 21 at a distance above the lower diaphragm 35. The upper diaphragm 36 is held gas tight, on the one hand at an upper end 37 of the upper part 34 of the valve rod 25, on the other hand between the first medium housing stage 21*b* and the second medium housing stage 21*c*, whereby the upper diaphragm 36 forms a gas tight flexible seal between the gas chamber 32 and the medium chamber 33.

Figure 4:
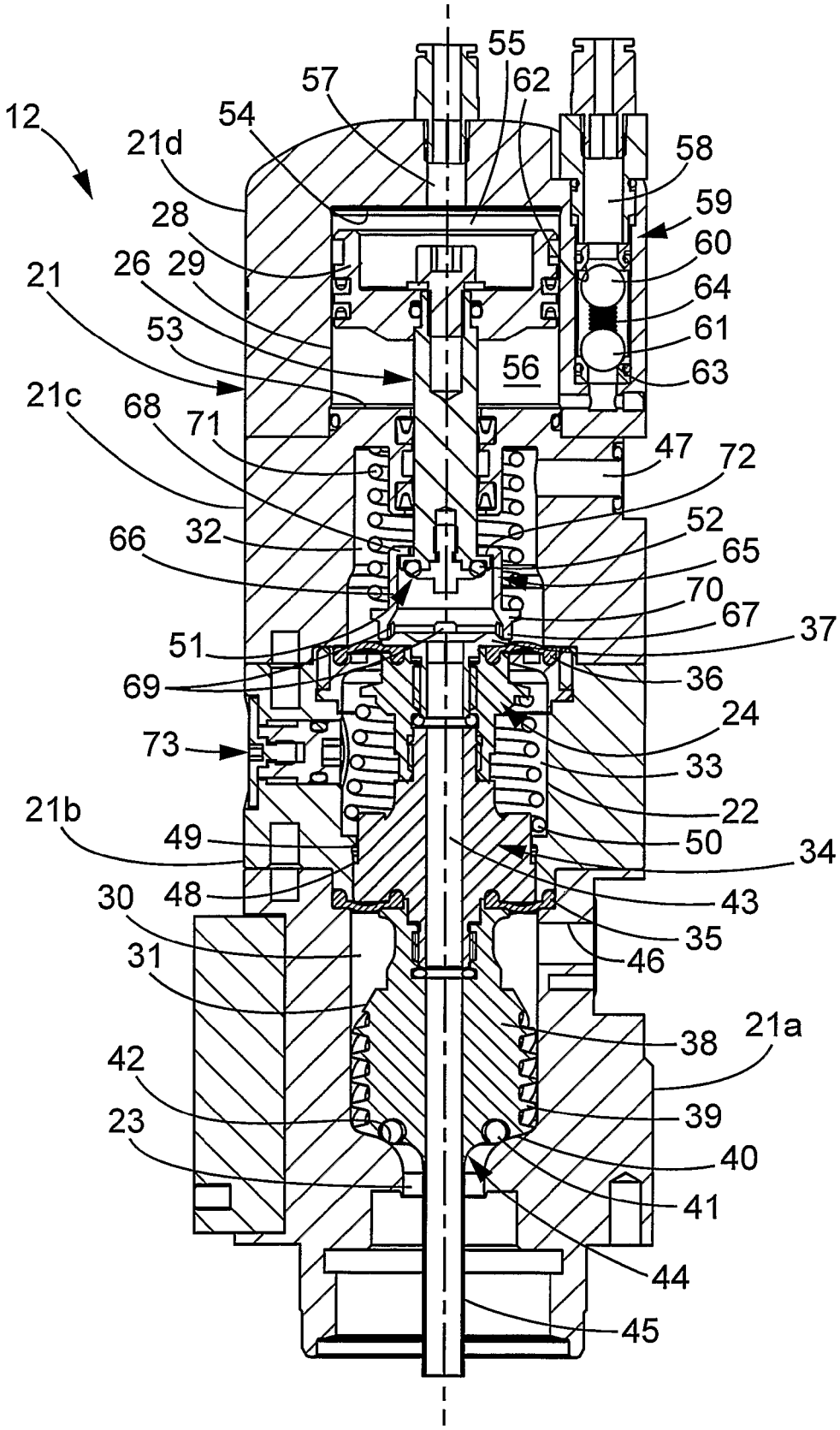
FIG. 4 is a view similar to FIG. 3, showing the filling valve in a gas filling configuration.
Figure 5:
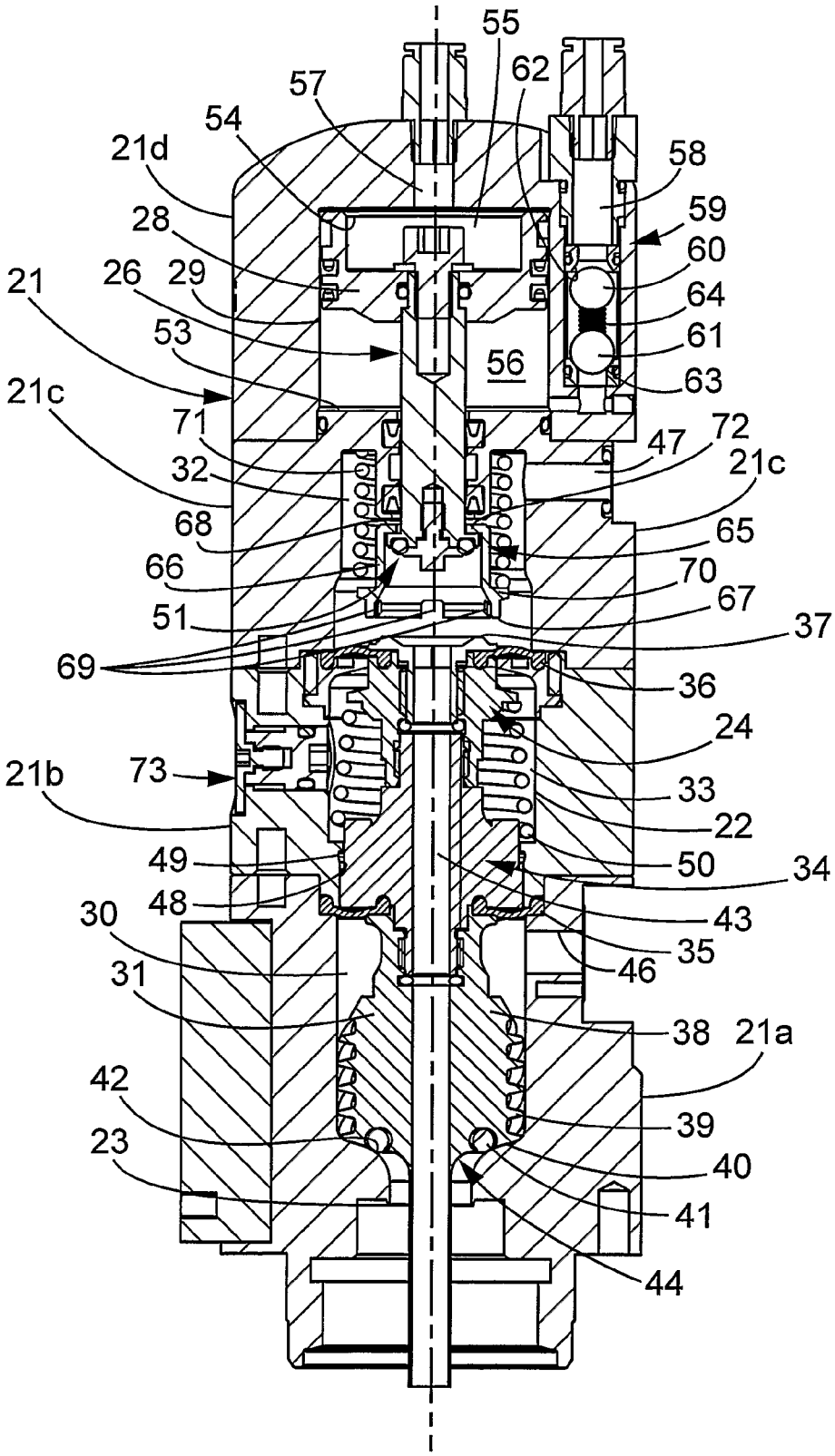
FIG. 5 is a view similar to FIGS. 3 and 4, showing the filling valve in a gas filling configuration.

The lower part 31 of the valve rod 25 forms a filling head 38 having a peripheral helical rib 39 cooperating with the inner periphery of the housing bore 22 and defining an annular contact surface 40 provided with a seal element 41 which abuts, in a liquid tight manner, a valve seat 42 formed in the vicinity of the housing aperture 23, in a closed position of the valve rod 25, shown on FIGS. 3, 4 and 5.

The valve rod 25 comprises a through hole 43 corresponding to the hollow portion of the valve rod 25 and constituting a gas passage for putting the gas chamber 32 in communication with the inside of the container 2. At the upper end 37 of the valve rod 25, the through hole 43 constituting the gas passage opens in the gas chamber 32, whereas at a lower end 44 of the valve rod 25 a gas pipe 45 axially protrudes from the filling head 38 to extend the through hole 43 towards the container 2.

The valve 12 also comprises a liquid inlet 46 formed by a through hole in the lower housing stage 21*a* for putting the liquid chamber 30 in communication with the liquid supply pipe 14, and a gas inlet 47 formed by a through hole in the second medium housing stage 21*c* for putting the gas chamber 32 in communication with the gas supply pipe 17.

The valve rod 25 is axially movable with respect of the housing 21, under certain conditions which will be disclosed hereafter, between:

- a closed position (FIGS. 3, 4, 5) in which the contact surface 40 is in liquid tight contact with the valve seat 42, thereby preventing the liquid from flowing from the liquid chamber 30 through the housing aperture 23, and
- an open position (FIG. 6) in which the valve rod 25 is elevated with respect of the closed position so that the contact surface 40 is spaced from the valve seat 42, thereby allowing the liquid to flow through the housing aperture 23, the helical rib 39 ensuring that the liquid flow is laminar.

The upper part 34 of the valve rod 25 is provided with an annular shoulder surface 48 which abuts, in the open position, against a corresponding annular stop surface 49 formed on the inner periphery of the housing bore 22 in the first medium housing stage 21*b* in order to limit the course of the valve rod 25.

The valve 12 comprises a first, lower, conical compression return spring 50, located in the medium chamber 33, and which permanently upwardly biases the valve rod 25 towards its open position. The upwardly axially oriented force exerted on the valve rod 25 by the lower spring 50 is referenced T1.

The piston body 27 has a lower end 51 provided with a seal member 52 which abuts against an annular seat formed by the upper end 37 of the valve rod 25 around the opening of the through hole 43, in a gas tight manner.

The piston 26 is axially slidingly mounted with respect of the housing 21, between

- a closed position (FIG. 3) in which the lower end 51 of the piston body 27 is in contact with the upper end 37 of the valve rod 25 and in which the piston head 28 is located near a lower surface 53 of the air chamber 29, thereby preventing gas from flowing through the through hole 43 constituting the gas passage, and
- an open position (FIGS. 5 and 6) in which the piston 26 is elevated with respect of the closed position so that the lower end 51 of the piston body 27 is spaced from the upper end 37 of the valve rod 25, the piston head 28 abutting against an upper surface 54 of the air chamber 29, thereby allowing gas to flow from the gas chamber 32 to the inside of the container 2 through the through hole 43 constituting the gas passage.

The piston 26 is of the double effect type, its position being air controlled by means of a pressure differential between an upper air chamber 55 defined between the piston head 28 and the upper surface 54 of the air chamber 29, and a lower air chamber 56 defined between the piston head 28 and the lower surface 53 of the air chamber 29.

The valve 12 further comprises a first air inlet 57 directly opening in the upper air chamber 55, and a second air inlet 58 opening in the lower air chamber 56 through a control valve 59 provided with a pair of movable balls 60, 61, i.e.

- a first, upper ball 60 having a closed position in which it abuts against a corresponding upper valve seat 62 in an air tight manner (FIG. 3), thereby preventing upstream airflow through the valve seat 62, and an open position in which the upper ball 60 is spaced from its valve seat 62 (FIGS. 4, 5 and 6), thereby allowing air to flow through the same up- and downstream, and a second, lower ball 61 having a closed position in which it abuts against a corresponding lower valve seat 63 in an air tight manner (FIGS. 4, 5 and 6), thereby preventing downstream airflow through the valve seat 63, and an open position in which the lower ball 61 is spaced from its valve seat 63 (FIG. 3), thereby allowing air to flow through the valve seat up- and downstream.

The balls 60, 61 are permanently biased away from each other (i.e. towards their respective closed positions) through a compression spring 64 interposed between them.

Air pressure from the first air inlet 57 is referenced P1, whereas air pressure from the second air inlet 58 is referenced P2. P1 is more than the sum of P2 and the overpressure resulting from the biasing force of the compression spring 64.

Air permanently comes under pressure P2 from the second air inlet 58. When the upper air chamber 55 is fed with air under pressure P1, the piston head 28 is moved downwards until the lower end 51 of the piston body 27 comes into abutment against the upper end 37 of the valve rod 25. The lower ball 61 is opened by the increasing pressure in the lower air chamber 56, whereas the upper ball 60 is closed, thereby preventing upstream airflow due to the overpressure in the lower air chamber 56 with respect of the second air inlet 58.

When the air feeding from the first air inlet 57 stops, the overpressure in the lower air chamber moves the piston head 28 upwards, until the piston head 28 comes into abutment with the upper surface 54 of the air chamber 29. Air feeding in the lower air chamber 56 is stopped when the lower ball 61 closes, under pressure differential between the second air inlet 58 and the lower air chamber 56, well before the piston 26 reaches its open position (see FIG. 4), thereby allowing smooth contact of the piston head 28 with the upper surface 54 of the air chamber 29.

As depicted on FIG. 3, the valve 12 further comprises a cup 65 slidingly mounted on the piston body 27 in the gas chamber 32. The cup 65 has a cylindrical peripheral wall 66 which surrounds the piston body 27 and defines a lower edge 67, and a top wall 68 slidingly contacting a peripheral outer surface of the piston body 27.

On its lower edge 67, the peripheral wall 66 is provided with cut-outs 69 forming gas passages which permanently allow gas to pass radially through the peripheral wall 66.

Figure 6:
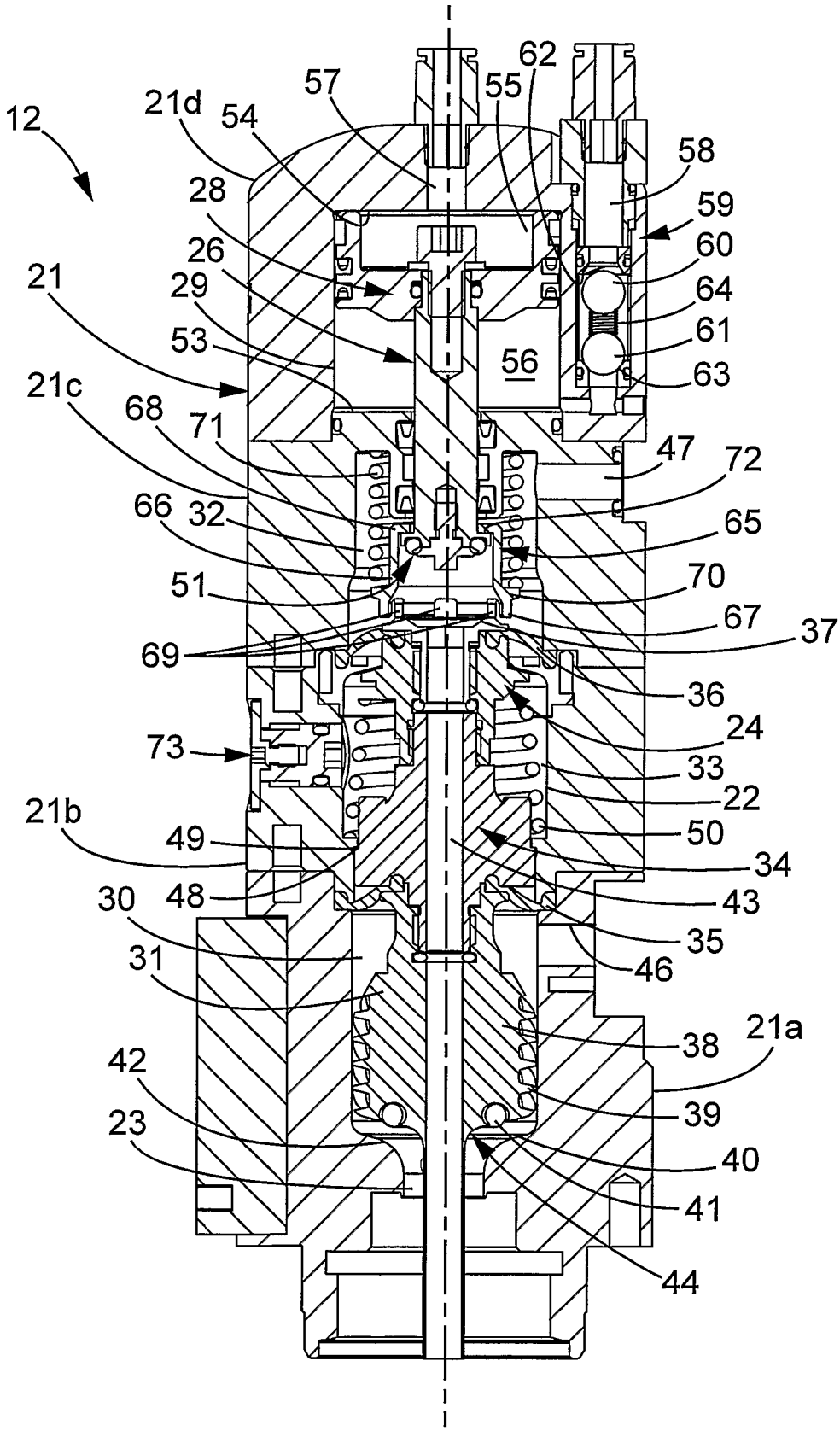
FIG. 6 is a view similar to FIGS. 3 to 5, showing the filling valve in a liquid filling configuration.

The cup 65 is slideable, with respect of the valve assembly 24, between a lower position, illustrated on FIGS. 3 and 4, in which the lower edge 67 abuts against the upper end 37 of the valve rod 25, and a higher position, illustrated on FIGS. 5 and 6, in which the cup 65 is elevated with respect of the lower position, under action of the piston 26, whereby the cup 65 is located at a distance from the valve rod 25.

As depicted on FIG. 3, the cup 65 is also provided, in the vicinity of its lower edge 67, with a radial annular flange 70, forming a contact surface for a second, upper, compression return spring 71 located in the gas chamber 32, and interposed between the housing 21 and the cup 65 for permanently downwardly biasing the cup 65 towards its lower position. The downwardly axially oriented force exerted on the cup 65 by the upper spring 71 is referenced T2.

It shall be understood that, in the lower position of the cup 65, the upper spring 71 also biases the valve rod 25 toward its closed position, since the cup 65 is in abutment against the upper end 37 of the valve rod 25.

As depicted on FIGS. 4 and 5, the piston 26 is provided with a shoulder surface 72 which, during the course of the piston 26 toward its open position, abuts against the top wall 68 of the cup 65, thereby displacing the same toward its higher position.

Accordingly, the valve assembly 24 can have three configurations, depending upon the respective positions of the valve rod 25, the piston 26 and the cup 65, namely:

a closed configuration, illustrated on FIG. 3, in which both the valve rod 25 and the piston 26 are in their closed position, whereas the cup 65 is in its lower position;

a gas filling configuration, in which the valve rod 25 is in its closed position, whereas the piston 26 is in its open position and the cup 65 in its higher position (FIG. 5), and a liquid filling configuration, in which both the valve rod 25 and the piston 26 are in their open position, whereas the cup 65 is in its higher position (FIG. 6).

Moreover, the springs 50, 71 and the upper and lower ends 37, 44 of the valve rod 25 are so dimensioned that:

$$P_g \times S2 > T1 \quad (1)$$

$$P_g \times S2 < T1 + P_g \times S1 \quad (2)$$

and $$T2 + P_g \times S2 > T1 + P_g \times S1 \quad (3)$$

where:

T1 is the upwardly axially oriented force exerted on the valve rod 25 by the lower spring 50;

T2 is the downwardly axially oriented force exerted on the cup 65 by the upper spring 71;

$P_g$ is the gas pressure in the gas chamber 32;

S1 is the surface area, considered axially, of the lower end 44 of the valve rod 25 exposed to the gas pressure in the container 2; and S2 is the surface area, considered axially, of the upper end 37 of the valve rod 25 exposed to the gas pressure in the gas chamber 32.

As depicted on FIG. 3, the valve 12 further comprises a diaphragm failure sensor 73, comprising a piston 74 slidingly mounted in a bore 75 formed in the housing 21 at the level of the first medium housing stage 21*b*, and a signal member 76 formed of a pellet attached to one end of the piston 74 opposed to the medium chamber 33 and visually accessible from the outside of the housing 21.

Under normal operational conditions, the medium chamber 33 is filled with air under atmospheric pressure, whereby the failure sensor 73 is in a so-called "normal operation" position (FIGS. 3 to 6), in which the pellet constituting the signal member 76 is received in a corresponding recess 77 formed in an outer surface of the housing 21.

As soon as the lower diaphragm 35 or the upper diaphragm 36 is no more liquid or, respectively, gas tight, e.g. after the diaphragm 35 or 36 has reached its fatigue limit, there is a liquid or gas leakage from the liquid or, respectively, from the gas chamber 32 toward the medium chamber 33 through the failing diaphragm 35 or 36. The resulting overpressure in the medium chamber 33, with respect of the atmospheric pressure, radially pushes the piston 74 toward a so-called "failure" position in which the piston 74 partly protrudes radially outside from the housing 21, whereby the signal member 76 extends at a distance from its recess 77, thereby signaling that a diaphragm failure occurred.

In one embodiment, the failure sensor 73 is of the passive type, i.e. it only provides "normal operation" or "failure information" concerning the valve 12.

In another embodiment, the failure sensor 73 is of the active type, i.e. it is electrically or mechanically connected to a machine control system (not shown) to stop operation of the same and shut off both gas and liquid feeding.

Given the presence of two diaphragms 35, 36, the risk of gas and liquid mutual contamination is very low in the event one of the diaphragms 35 or 36 fails (e.g. the diaphragm 35 or 36 breaks).

Given the presence of the failure sensor 73, either the machine operator is immediately warned that a diaphragm failure occurred, so that he can stop the machine and achieve (or ask for) the appropriate maintenance (in the meantime the machine still runs, so that productivity is maintained), or the machine is automatically stopped by its control system under displacement of the failure sensor 73.

Figure 2:
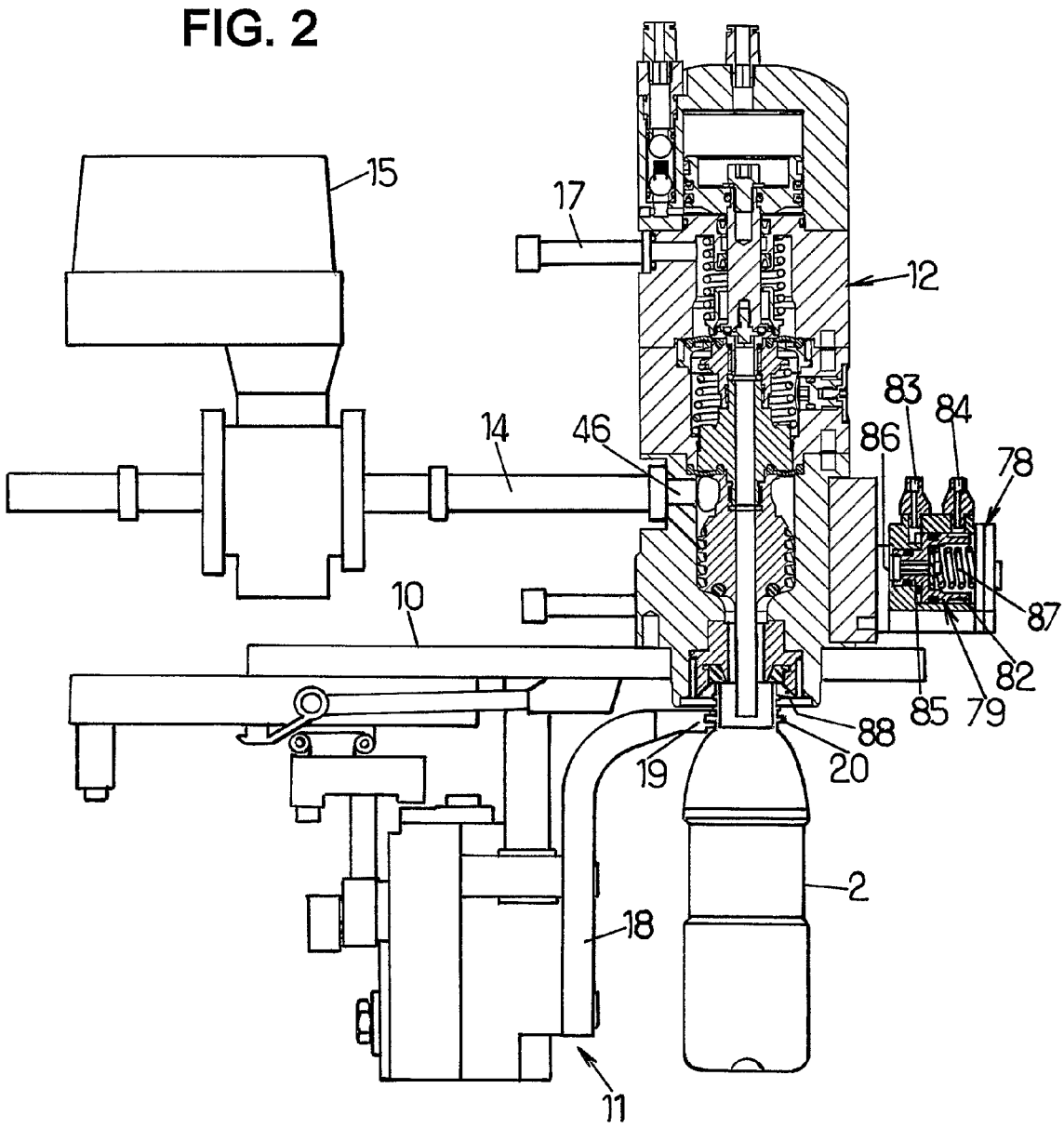
FIG. 2 is a side elevational section view showing a detail of the filling machine of FIG. 1.
Figure 7:
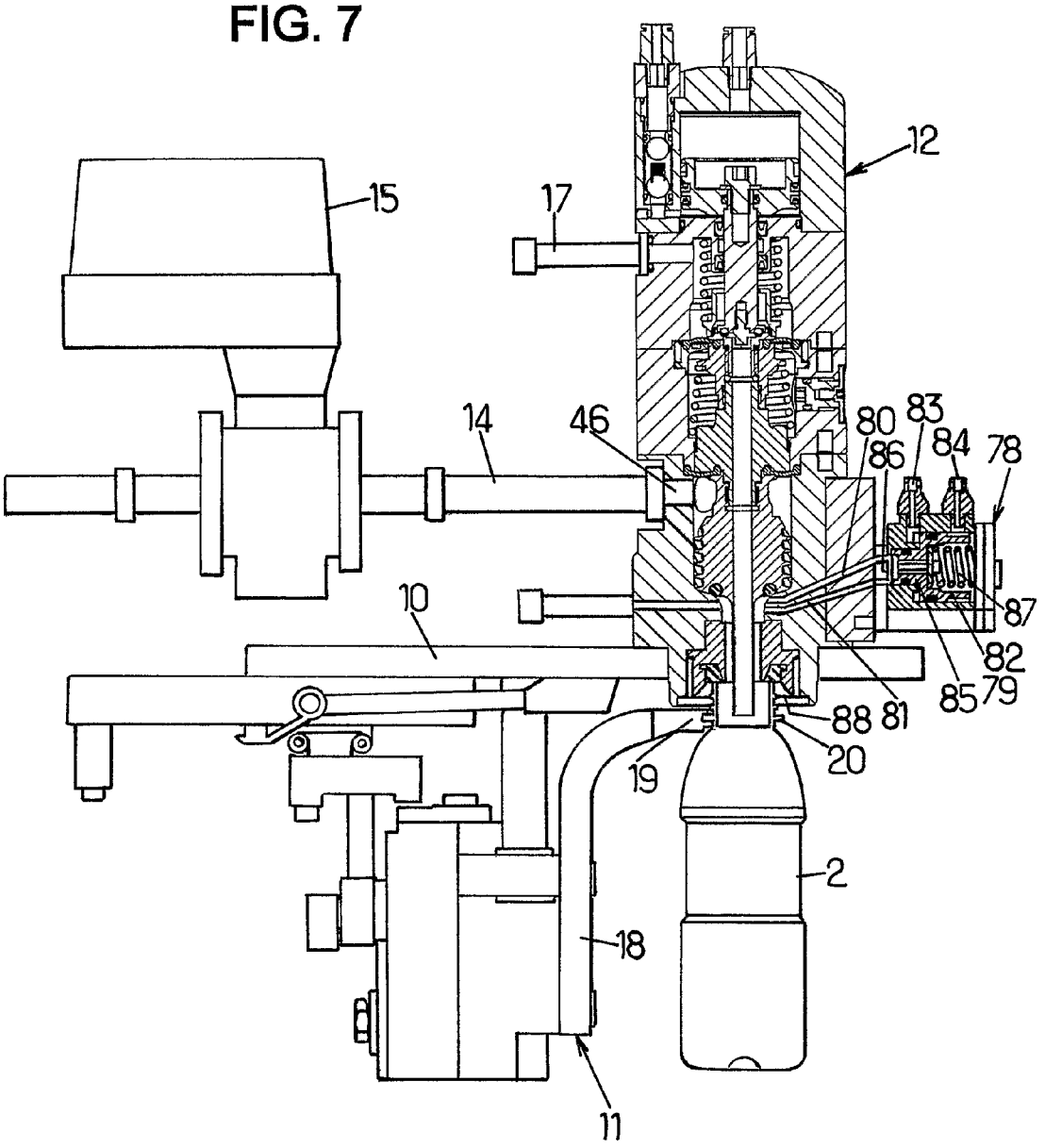
FIG. 7 is a view similar to FIG. 2, showing an air exhaust operation of the container.

As depicted on FIGS. 2 and 7, the valve 12 is provided with a snifter valve 78 including a double effect piston 79 slideable between an open position (FIG. 7) in which it puts an exhaust conduit 80 formed in the housing 21 and opening in the bore 22 at the level of its aperture 23 (i.e. in the vicinity of the valve seat 42) in communication with an exhaust pipe 81 opening to the atmosphere, and a closed position in which the piston 79 shuts the exhaust conduit 80.

More precisely, the piston 79 has a head 82, the position of which is controlled by an air pressure differential on both sides thereof via air ducts 83, 84 sequentially feeding the snifter valve 78 with pressurized air, and a body 85, an end of which can be put in gas tight contact with a side surface 86 of the housing 21, where both the exhaust conduit 80 and the exhaust pipe 81 open.

In the open position of the piston 79, the end of the piston body 85 is spaced from the side surface 86, thereby putting the exhaust conduit 80 in communication with the exhaust pipe 81 and allowing the overpressure gas to flow from the container 2 to the atmosphere, until the gas pressure in the container 2 has reached a predetermined pressure wherein it can no more compensate the force exerted on the piston 79 by the air pressure, cumulated with the biasing force of a return spring 87 permanently biasing the piston 79 toward its closed position.

Such an exhausting operation (also called shift operation) prevents the $CO_2$-saturated liquid from foaming when the container 2 is separated from the valve 12 at the end of the filling.

The filling operations are now described.

Starting from the closed configuration of the valve assembly 24, a container 2 (such as a bottle) is attached to the valve 12 at the bore aperture 23 through a gas tight joint assembly 88.

Air is fed to the lower air chamber 56 through the second air inlet 58 via the control valve 59, thereby putting the piston 26 in its open position and the cup 65 in its higher position. In other words, the valve assembly 24 is put in its gas filling configuration. Pressurized gas is thereby allowed to inside of the container 2 through the through hole 43 constituting the gas passage. Equation (1) is verified as long as the gas pressure in the container 2 is lower than the gas pressure $P_g$ in the gas chamber 32 (which is equal to the gas pressure in the gas space 6 of the storage tank 3), so that the valve rod 25 remains in its closed position.

Once the gas pressure equilibrium is reached, i.e. once the gas pressure in the container 2 has reached the gas pressure $P_g$ in the gas chamber 32, equation (2) is verified, so that the valve rod 25 is elevated under the upwardly directed force exerted by the lower spring 50 and the force resulting from the gas pressure $P_g$ in the container 2, the sum of which is greater than the downwardly directed force exerted on the valve rod 25 by the gas pressure $P_g$ in the gas chamber 32. The valve assembly 24 then occupies its liquid filling configuration.

Liquid is thereby allowed to flow from the liquid chamber 30 to the container 2 through the aperture 23, until the flow meter 15 has measured the predetermined amount of liquid substantially corresponding to the volume of the container 2.

The liquid flow is then stopped under control of the flow meter 15, whereas the piston 26 is displaced to its closed position, thereby shutting off the through hole 43 to the container 2. The cup 65 is back to its lower position, in which the upper spring 71 downwardly biases the valve rod 25. Equation (3) is therefore verified, the valve assembly 24 being back to its closed configuration.

The snifter valve 78 is then put in its open position, thereby allowing the exhausting of part of the mixture of air and $CO_2$ overlying above the liquid in the container 2.

More precisely, since air is lighter than $CO_2$, the exhausted gas essentially consists of air, the remaining gas in the container 2 essentially consisting of $CO_2$.

Accordingly, it shall be understood that operation of the valve assembly 24, and more specifically the transition from the gas filling configuration to the liquid filling configuration, is gas pressure-controlled, thereby allowing automatic opening of the valve rod 25.

The invention claimed is:

1. A filling valve comprising:

a hollow housing;

a sliding valve assembly disposed in the hollow housing, said sliding valve assembly and said hollow housing forming a liquid chamber and a gas chamber;

a liquid inlet which connects said liquid chamber with a liquid supply pipe;

a gas inlet which connects said gas chamber with a gas supply pipe;

wherein said sliding valve assembly comprises:

a hollow valve rod provided with a through hole opening in said gas chamber at an upper end of said valve rod, said valve rod sliding with respect to the housing between an open position in which the valve rod opens an aperture in the housing, thereby allowing liquid to flow from the liquid chamber through said aperture, and a closed position in which the valve rod closes said aperture, and a sliding piston disposed in the housing between an open position in which a lower end of the piston is spaced from the upper end of the valve rod, thereby allowing gas to pass from the gas chamber to the through hole in the valve rod through the opening formed at the upper end of the valve rod, and a closed position in which the lower end of the piston contacts and seals the upper end of the valve rod.

2. The filling valve according to claim 1, comprising a first return spring biasing the valve rod toward an open position.

3. The filling valve according to claim 2, further comprising:

a cup disposed in the gas chamber which slides with respect to the piston between a lower position, in which a lower edge of the cup abuts against the upper end of the valve rod, and a higher position in which the cup is spaced from the upper end of the valve rod, wherein said cup comprises cut-outs which allow gas to pass from the gas chamber to the through hole through the cut-outs, and wherein said sliding valve assembly further comprising a second return spring biasing said cup toward the lower position.

4. The filling valve according to claim 3, wherein when the piston is in the open position, the cup is maintained the higher position.

5. A filling machine for the isobaric filling of a container, said machine comprising:

a rotary carrousel equipped with a plurality of filling valves according to claim 3; and, a storage tank comprising a liquid space connected to the liquid chamber of each one of the plurality of filling valves and an overlying gas space connected to the gas chamber of each one of the plurality of filling valves, wherein the dimensions of the first and second return springs and the valve rod are determined according to the following equations:

$$P_g \times S2 > T1$$

$$P_g \times S2 < T1 + P_g \times S1$$

and $$T2 + P_g \times S2 > T1 + P_g \times S1$$

where:

T1 is the axial force exerted on the valve rod by the first return spring;

T2 is the axial force exerted on the cup by the second return spring;

$P_g$ is the gas pressure in the gas space;

S1 is the surface area, considered axially, of a lower end of the valve rod exposed to the gas pressure in the container; and S2 is the surface area, considered axially, of the upper end of the valve rod exposed to the gas pressure in the gas chamber.

6. The filling valve according to claim 1, wherein the sliding piston comprises a sliding piston head disposed in an air chamber formed of a cylindrical bore which the sliding head separates in an upper air chamber and a lower air chamber, and wherein the filling valve further comprises a first air inlet opening in the upper air chamber and a second air inlet opening in the lower air chamber for which control the position of the piston head through an air pressure differential between the upper and lower air chambers.

7. The filling valve according to claim 6, wherein the second air inlet opens in the lower air chamber through a double ball control valve.

8. The filling valve according to claim 7, wherein the control valve comprises a movable first ball capable of occupying a closed position in which the movable first ball blocks upstream airflow from the lower air chamber to the second air inlet, and a second ball capable of occupying a closed position in which the movable second ball blocks downstream airflow from the second air inlet to the lower air chamber.

9. The filling valve according to claim 8, wherein the control valve further comprises a compression spring which biases the balls of the control valve toward their closed position.

10. An isobaric filling machine comprising:

a rotary carrousel equipped with a plurality of filling valves according to claim 1 and a storage tank comprising a liquid space connected to the liquid chamber of each one of the plurality of filling valves and an overlying gas space connected to the gas chamber of each one of the of the plurality of filling valves.

11. The filling valve according to claim 1, further comprising:

a medium chamber disposed between the gas chamber and the liquid chamber.

* * * * *